US005692611A

United States Patent [19]

Harrison

[11] Patent Number: 5,692,611

[45] Date of Patent: Dec. 2, 1997

[54] PACKED ELECTRIC LAMP

[75] Inventor: Guy N. P. Harrison, Bentley Near Faeham, Great Britain

[73] Assignee: U.S. Philips Corporation, New York, N.Y.

[21] Appl. No.: 615,757

[22] Filed: Mar. 13, 1996

[30] Foreign Application Priority Data

Mar. 17, 1995 [EP] European Pat. Off. ..... 95200652

[51] Int. Cl.[6] ..... B65D 85/42

[52] U.S. Cl. ..... 206/418; 206/485; 206/779

[58] Field of Search ..... 206/418–420, 206/779, 780, 485

[56] References Cited

U.S. PATENT DOCUMENTS

| | | | |
|---|---|---|---|
| 1,932,705 | 10/1933 | Menten . | |
| 2,368,753 | 2/1945 | Elliott et al. | 206/419 X |
| 3,405,860 | 10/1968 | Manizza | 206/485 |
| 3,517,801 | 6/1970 | Cote | 206/779 |
| 4,037,717 | 7/1977 | Roccaforte . | |
| 4,572,362 | 2/1986 | Kronfeld . | |
| 5,048,676 | 9/1991 | Borgis et al. | 206/419 |

FOREIGN PATENT DOCUMENTS

| | | | |
|---|---|---|---|
| 999898 | 10/1951 | France | 206/485 |
| 2219661 | 9/1974 | France . | |
| 4103018 | 8/1992 | Germany | 206/418 |
| 4121566A1 | 1/1993 | Germany . | |
| 685720 | 1/1953 | United Kingdom | 206/419 |
| 1004654 | 9/1965 | United Kingdom . | |

*Primary Examiner*—Bryon P. Gehman
*Attorney, Agent, or Firm*—Walter M. Egbert, III

[57] ABSTRACT

The packed electric lamp has a back wall with a first sleeve comprising a base and a first fixation wall with an opening, and a second sleeve comprising a top and a second fixation wall with an opening. Side walls are connected to the back wall and fastened to the first and second sleeves by means of folded tongues. The lamp is held fixed in the with respective end portions. The packing keeps the lamp securely fixed in place, while nevertheless a substantial portion of the lamp is visible. The packing may be readily shaped from its blank and simultaneously made to hold the lamp.

24 Claims, 3 Drawing Sheets

PACKED ELECTRIC LAMP

BACKGROUND OF THE INVENTION

The invention relates to a packed electric lamp comprising:

an electric lamp with a light-transmitting lamp vessel, which lamp has a first end portion which supports a lamp cap, and opposite thereto a second, free end portion;

an open packaging in which the electric lamp is enclosed, visible for a major portion, which packaging has a back wall and a first side wall and, connected thereto and in mutual opposition, a base and a top, respective fixation walls being provided at a distance from the base and from the top, each provided with an opening in which the first and second end portions, respectively, of the lamp are held fixed in position.

Such a packed electric lamp is known from U.S. Pat. No. 4,572,362.

The known packed electric lamp shows a major portion of the lamp. This is important because electric lamps are manufactured in many shapes and finishes, and it is sometimes difficult for the consumer to choose the desired lamp exclusively on the basis of printed information. Nevertheless, it is desirable that such a packed electric lamp cannot be taken from its packaging in the shop and be replaced in this packaging by a lamp of a more expensive kind.

In the known packed electric lamp it is entirely dependent on a very accurate dimensioning of the openings in the fixation walls and of their interspacings whether the packaging, as long as it is not deformed or damaged, actually lutes the lamp in position.

It is an additional major disadvantage of the known packed electric lamp that shaping of the packaging is very complicated, and that it is necessary to make convex as well as concave folds in the presence of the lamp during shaping. Added to this is the circumstance that approximately half the great number of operations to be performed consecutively must be performed in the presence of the lamp to be packed. The construction of the packaging, moreover, renders dimensional accuracy very uncertain. Another drawback is that the packaging strongly exposes the lamp and involves the risk of damage, owing to its prismatic shape. The packed electric lamp is also difficult to arrange in stacks.

A next disadvantage is that the known packaging offers little space for graphic information on the packed lamp. Given the plurality of lamp types for consumer use it is important, for example, to know what is the colour or colour temperature of a lamp, for example in the case of compact fluorescent lamps, what is its operational life, and what is the lumen output. These data can often only be clarified through a comparison with an incandescent lamp for general lighting purposes. In a market area where several languages are spoken, it is in addition desirable to provide this information in those languages.

A packed electric lamp is known from U.S. Pat. No. 1,932,705 wherein the lamp is enclosed in a slide which is passed into a box sleeve. The slide is made up from a base surface on which buffer sleeves are arranged in mutual opposition and pivotably connected to the base surface, which sleeves are open towards the base surface and away from the base surface. The sleeves have respective openings in their mutually opposing walls, in each of which an end portion of the lamp is enclosed. The sleeves form buffers for the lamp and end faces for the box.

SUMMARY OF THE INVENTION

It is an object of the invention to provide a packed electric lamp of the kind described in the opening paragraph which can be easily assembled together from the lamp and the blank of the packaging, and wherein the lamp is nevertheless satisfactorily fixed. It is another object to provide such a packed electric lamp which provides space for graphic information.

According to the invention, this object is achieved in that the base, a first of said fixation walls and a first front wall together with the back wall, interconnected along folding lines, form a first sleeve, and the top, the second of said fixation walls and a second front wall together with the back wall, interconnected along folding lines, form a second sleeve, and the back wall merges into a second side wall opposite the first side wall, which side walls are connected to the back wall along folding lines and are each coupled to the first sleeve and to the second sleeve by means of folded tongues.

The packed electric lamp can be readily assembled from the lamp and the blank of the packaging, as will be explained with reference to FIG. 2. The packaging keeps the lamp satisfactorily fixed in place, while it nevertheless provides scope for observing a major portion of the lamp. The front walls offer a space for graphic information, so that essential lamp data can be viewed at a glance.

The open packaging can be so designed that folding takes place in the same direction about all folding lines, i.e. during folding relative to a first surface of the blank an angle smaller than 180°, for example 90°, is made each time. This benefits the ease of packaging.

It is favorable when the fixation walls have a support near the back wall, which support prevents the fixation walls from sliding along the back wall in the direction of the base and the top, respectively. This support may comprise, for example, one or several tongues at the fixation walls which extend along the back wall towards the base and the top and thus eliminate or limit a risk of gliding. In general, however, such a support is not necessary.

In an advantageous embodiment, the sleeves have a rectangular cross-section, and the fixation walls have respective fastening strips with which they are fastened to the back wall. This embodiment has the advantage that the sleeves can already be prepared after printing of the blank and that the packaging-to-be nevertheless remains plane. It is convenient in this case, and in addition the packaging remains comparatively thin, when the blank is folded on the folding line between the base or top and the relevant front wall, while the fastening strip lies in the extended direction of the fixation wall. This is more convenient than if the fastening strip were folded back onto the fixation wall and be thus fastened to the back wall, although in this preferred case a fold in the opposite direction win arise said fold arrives automatically, however while the packaging is being shaped.

In a special embodiment, the packaging comprises panels which extend away from the side walls and are connected thereto along folding lines, which panels continue to between the lamp and the back wall. This embodiment has the advantage that, if only one side of the blank has a finish, for example a printing, substantially exclusively this side becomes visible. In a modification of this embodiment, the panels are coupled adjacent the lamp for an increased ease of packaging. The panels may be coupled, for example, by their matching shapes, for example by a cooperating toothing, or by means of an incision and a tag which is inserted therein.

It is possible for the tongues coupling the first sleeve to the side walls to be present at the first front wall. It is alternatively possible, however, for these tongues to be present at the side walls or at the base.

Thus it would also be possible for the tongues coupling the second sleeve to the side walls to be present at the second front wall, although each of the alternatives corresponding to the preceding paragraph is also possible.

In a favorable embodiment, a front panel is present at the first side wall, which panel overlaps substantially only the first and the second front wall. This front panel may be attached to the front walls, for example, with glue. In a favorable modification, the front panel has a side panel which overlaps the second side wall and is attached thereto. This modification has the advantage that the packaging can be flat until just before the moment an electric lamp is inserted into it, while the packaging can nevertheless be quickly formed from the flat shape into a main sleeve open at two opposed ends with the side panel already attached to the second side wall.

The main sleeve may subsequently be closed at one end in that, for example, the first sleeve is brought into an upright position and is inserted into the main sleeve in a revolving movement. Tongues for coupling the second side wall to the first or second sleeve may be present at the side panel.

After a lamp has entered the main sleeve, which is still open at one end, the main sleeve may be closed at the second end in that, for example, the second sleeve in put upright and revolved inwards.

In a further modification, the front panel comprises a top panel which covers the top. If so desired, a suspension tag with an eyelet may be cut out from the top panel. The top panel may be double-walled, as desired, for greater strength. The top panel may be affixed, for example with glue, for example to the top, any folded tongues present at the side walls or at the side panel being closed in thereby, and/or may be affixed to said folded tongues.

By analogy, a base panel may be present at the front panel, overlapping the base In a favorable embodiment for those geographic areas where several kinds of lamp caps are current, the first front wall has a window through which the lamp cap can be viewed, so that it can be ascertained whether, for example, a bayonet or Edison cap is present.

The packaging may readily be given a suspension tag at the top with an eyelet, for example a Euroslot. When the packaging is given a standard width of articles for display panels, there will be plenty of space on the panels on either side of the lamp for graphic, for example alphanumerical information.

Suitable means may be used for making the fastenings, for example, glue.

The packaging may be shaped, for example, from material comprising cellulose such as, for example, cardboard, for example semi- or mini-corrugated cardboard, but particularly from duplex cardboard.

BRIEF DESCRIPTION OF THE DRAWINGS

An embodiment of the packed electric lamp according to the invention is shown in the drawings, in which.

DESCRIPTION OF THE PREFERRED EMBODIMENTS

Figure 1:
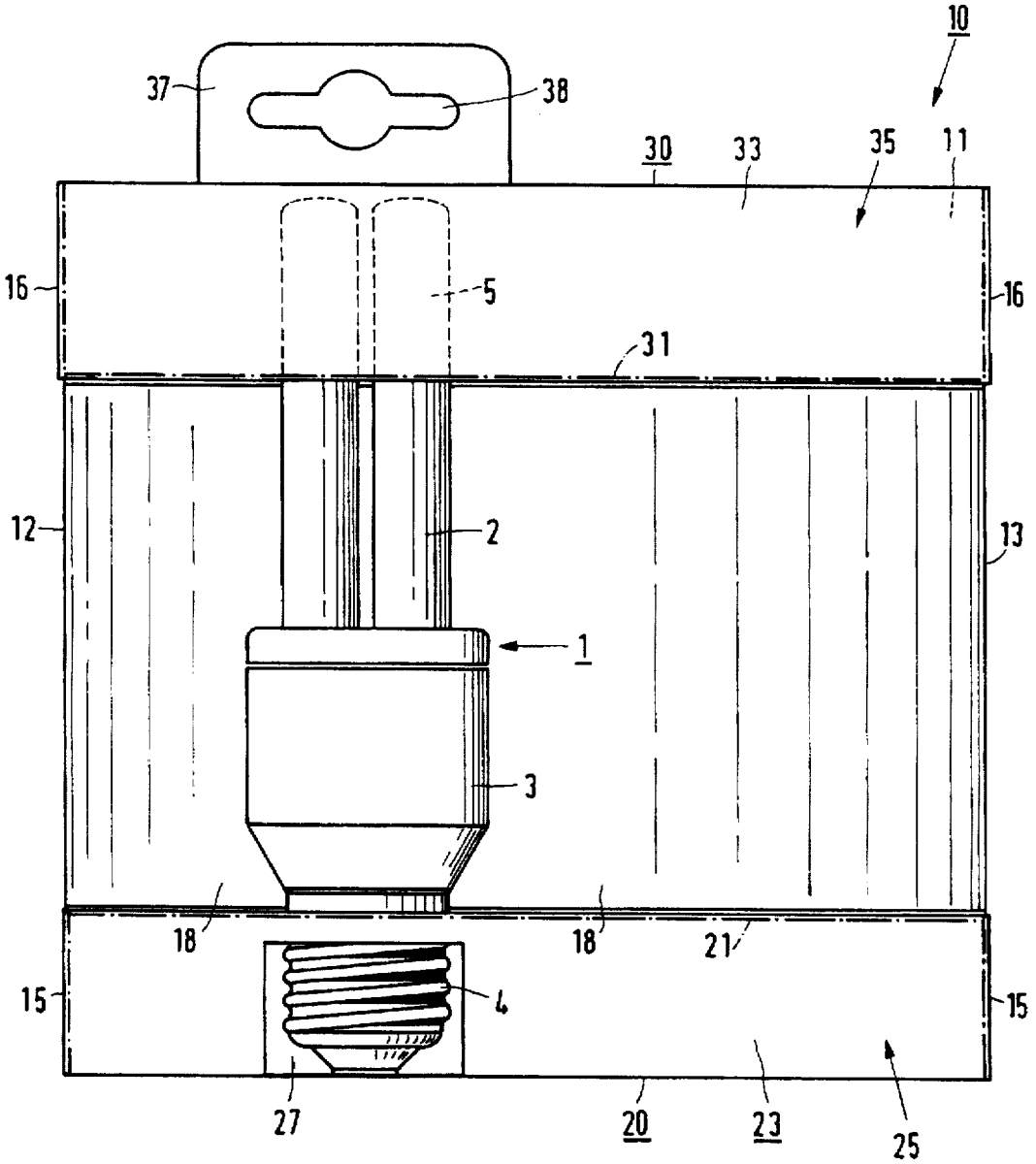
FIG. 1 is a front elevation of a packed electric lamp.

In FIG. 1, the packed electric lamp 1 has a light-transmitting lamp vessel 2, a first end portion 3 which supports a lamp cap 4, and opposed thereto a second free end portion 5. The lamp enclosed in an open packaging 10 is visible for a major portion. The lamp shown is a compact fluorescent lamp in which the first end portion comprises electronic circuits for igniting and operating the lamp.

The packaging 10 (see also FIG. 2) has a back wall 11 and a first side wall 12 and, connected thereto and in mutual opposition, a base 20 and a top 30. At a distance from the base 20 and from the top 30, respective fixation walls 21 and 31 are provided, each provided with an opening 22, 32 in which the first 3 and second end portion 5 of the lamp 1, respectively, are held fixed in position.

The base 20, a first fixation wall 21 as mentioned above, and a first front wall 23 together with the back wall 11, interconnected along folding lines 24, form a first sleeve 25, while the top 30, the second fixation wall 31 as mentioned above, and a second front wall 35 together with the back wall 11, interconnected along folding lines 34, form a second sleeve 35.

The back wall 11 merges into a second side wall 13 opposite the first side wall 12, these side walls 12, 13 being connected to the back wall 11 along folding lines 14, while they are each coupled to the first sleeve 25 and to the second sleeve 35 by means of folded tongues 15, 16.

The sleeves 25, 35 are rectangular in cross-section, and the fixation walls 21, 31 have respective fastening strips 26, 36 with which they are fastened to the back wall 11.

Panels 18 extend to between the lamp 1 and the back wall 11 away from the side walls 12, 13, connected thereto along folding lines 17, thus substantially bridging the distance between the sleeves 25, 35.

Figure 2:
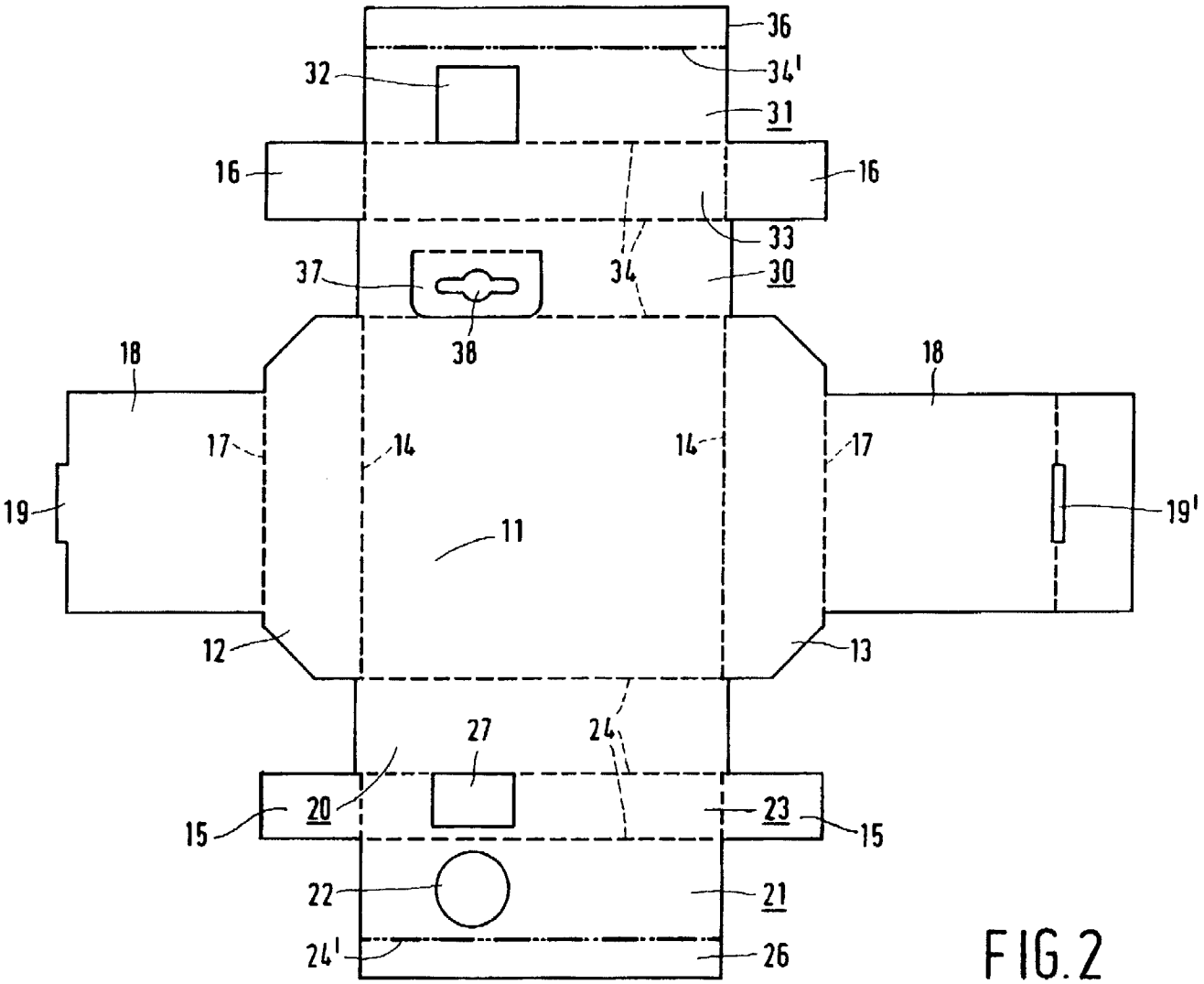
FIG. 2 shows the blank of the packaging of FIG. 1.

The panels 18 are coupled adjacent the lamp 1, in the Figure by means of matching shapes (see FIG. 2).

The tongues 15 which couple the first sleeve 25 to the side walls 12, 13 are present at the first front wall 23.

The tongues 16 which couple the side walls 12, 13 to the second sleeve 35 are present at the second front wall 33.

A window 27 through which the lamp cap 4 is visible is present in the first front wall 23.

A suspension tag 37 with an eyelet 38 has been cut from the top 30.

The lamp cannot be taken from the packaging without this packaging being torn.

It is apparent from FIG. 2 that the packaging may consist of one sheet of packaging material, duplex cardboard in the embodiment shown.

To manufacture the packed electric lamp of FIG. 1, the blank was folded about the folding line 24 between the base 20 and the first front wall 23 and about the folding line 34 between the top 30 and the second front wall 33, after the fastening strips 26, 36 had been provided with glue for sticking them to the back wall. A plane product was obtained thereby of approximately twice the material thickness. To obtain a subsequent substantially perpendicular connection of the fixation walls 21, 31 to the back wall 11, the lines 24' and 34' along which the fixation walls are connected to the relevant fastening strips 26, 36 are cut/crease lines.

In an alternative embodiment of the packaging, the fastening strips 26, 36 are folded back onto the relevant fixation walls 21, 31 before being adhered to the back wall 11, so with their other surface as compared with the preceding embodiment. In a modification of this embodiment, the fastening strips are used as the support mentioned above for the fixation walls in order to counteract sliding of these walls along the back wall. It is favorable in this case when their dimensions correspond to those of the relevant front wall.

When the prepared product of the embodiment shown is to be used for packaging the lamp, the first sleeve 25 is raised, after which the side walls 12, 13 are pivoted upwards about the folding lines 14 and the tongues 15, for example provided with glue, are bent and adhered to the relevant side walls.

In the embodiment shown, the panels 18 are then folded inwards about the folding lines 17 and interconnected in that the tag 19 is brought into engagement with the incision 19'.

Now the lamp 1 is inserted with its lamp cap 4 into the opening 22 of the first fixation wall 21. The second sleeve 35 is subsequently erected, during which the opening 32 in the second fixation wall 31 passes over the free end portion of the lamp. To facilitate the shaping of the second sleeve still further, the side walls 12, 13 are bevelled near the top 30. Finally, the tongues 16, for example provided with glue, are folded and adhered to the relevant side walls 12, 13. The bevelling of the side walls 12,13 near the base 20 facilitates the erection of the packaging in an alternative procedure in which the first sleeve 25 is erected only after the side walls pivoted upwards.

It is evident from the above that only one side of the blank, i.e. the lower side in FIG. 2, faces the exterior in the packed lamp and is visible, except for the material behind the window 27.

It will be apparent that lamps of other shapes can equally be pecked in an adequately shaped packaging of the kind described, e.g. lamps having a cap attached to a tubular or bulbous lamp vessel, or a tubular lamp vessel having a bulbous intermediate portion.

Figure 3:
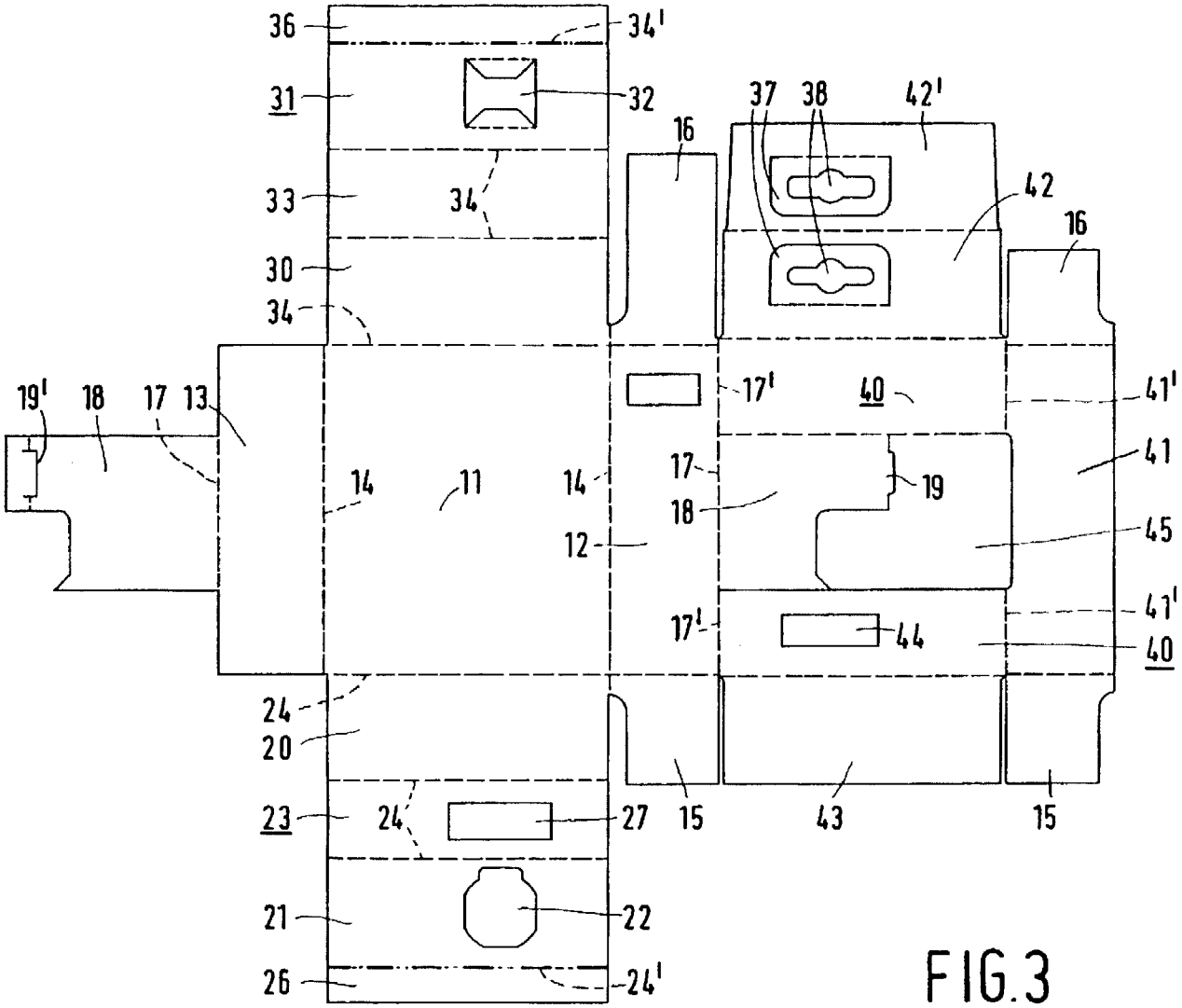
FIG. 3 shows the blank of an alternative embodiment.

In FIG. 3, parts corresponding to those in FIG. 2 have been given the same reference numerals.

The blank may be supplied to the packaging bench or machine in the state in which the fastening strips 26 and 36 are fixed to the back wall 11 and a fold is present about the folding line 24 between the base 20 and the first front wall 23, and also a fold about the folding line 34 between the top 30 and the second front wall 33. The first sleeve 25 or second sleeve 35 which is to be made from this is still flat then.

The blank shown comprises a front panel 40, in which one of the panels 18 is still present in FIG. 3, and a window 45 which will be entirely open when the panel 18 is folded away from it and through which the packed lamp will be visible in the finished product, as in FIG. 1. The front panel 40 is connected to the first side wall 12 along a folding line 17' and has a side panel 41, to which it is connected along a folding line 41'. The side panel 41 has tongues 15, 16.

Upon delivery, the blank may be folded about the folding line 14 between the back wall 11 and the second side wall 13, and also about the folding line 17,17', the side panel 41 being attached to the second side wall 13 so that a flat product is obtained. A three-dimensional main sleeve may be formed therefrom immediately before the moment a lamp is packed. The panels 18 may be pressed inward and brought into engagement with one another.

The second sleeve 35 (see FIG. 1) may then be put upright and revolved into the main sleeve, whereupon the first 12 and the second side wall 13 may be connected to the second sleeve by means of the tongues 16.

After the insertion of an electric lamp to be packed, the first sleeve 25 (see FIG. 1) may be raised and revolved into the interior. The first 12 and the second side wall 13 may be coupled to the first sleeve 25, i.e. to the base 20, by means of the tongues 15.

The first front wall 23 has a window 27 through which the lamp cap of the packed electric lamp is visible. A corresponding window 44 is present in the front panel 40 for this purpose.

In the embodiment shown, the front panel 40 comprises a top panel 42,42' which is double-walled because the portions 42 and 42' thereof have been brought against one another, for example, glued together. The top panel 42,42' may be connected to the top 30 over the folded tongues 16. Similarly, the front panel has connected to it a base panel 43 which is also connected to the base 20 and/or to the folded tongues 15.

I claim:

1. A packed electric lamp comprising:

an electric lamp with a light-transmitting lamp vessel, which lamp has a first end portion which supports a lamp cap, and opposite thereto a second, free end portion;

an open packaging enclosing the electric lamp, such that a substantial portion of the electric lamp is visible , which packaging has a back wall and a first side wall and, connected thereto and in mutual opposition, a base and a top, respective fixation walls being provided at a distance from the base and from the top, each provided with an opening in which the first and second end portions, respectively, of the lamp are held fixed in position, characterized in that:

the base, a first of said fixation walls and a first front wall together with the back wall, interconnected along folding lines, form a first sleeve, and the top, the second of said fixation walls and a second front wall together with the back wall, interconnected along folding lines form a second sleeve, and the back wall merges into a second side wall opposite the first side wall, which side walls are connected to the back wall along folding lines and are each coupled to the first sleeve and to the second sleeve by means of folded tongues.

2. A packed electric lamp as claimed in claim 1, characterized in that the sleeves each have a rectangular cross-section, and the fixation walls have respective fastening strips with which they are fastened to the back wall.

3. A packed electric lamp as claimed in claim 2, characterized in that panels extend from the side walls to between the lamp and the back wall, which panels are connected to said side walls via folding lines and together substantially bridge the distance between the sleeves.

4. A packed electric lamp as claimed in claim 3, characterized in that the panels are coupled adjacent the lamp.

5. A packed electric lamp as claimed in claim 4, characterized in that the panels are coupled by means of matching shapes.

6. A packed electric lamp as claimed in claim 3, characterized in that a front panel is present at the first side wall, which front panel overlaps substantially only the first and the second front wall.

7. A packed electric lamp as claimed in claim 6, characterized in that the front panel comprises a side panel which overlaps the second side wall and is fastened thereto.

8. A packed electric lamp as claimed in claim 6, characterized in that the first front wall has a window through which the lamp cap can be viewed.

9. A packed electric lamp as claimed in claim 6, characterized in that the front panel has a top panel which overlaps the top and from which a suspension tag with an eyelet has been cut out.

10. A packed electric lamp as claimed in claim 3, characterized in that a suspension tag with an eyelet has been cut from the top.

11. A packed electric lamp as claimed in claim 3, characterized in that the first front wall has a window through which the lamp cap can be viewed.

12. A packed electric lamp as claimed in claim 2, characterized in that a front panel is present at the first side wall, which front panel overlaps substantially only the first and the second front wall.

13. A packed electric lamp as claimed in claim 12, characterized in that the front panel comprises a side panel which overlaps the second side wall and is fastened thereto.

14. A packed electric lamp as claimed in claim 2, characterized in that the first front wall has a window through which the lamp cap can be viewed.

15. A packed electric lamp as claimed in claim 2, characterized in that a suspension tag with an eyelet has been cut from the top.

16. A packed electric lamp as claimed in claim 15, characterized in that the front panel has a top panel which overlaps the top and from which a suspension tag with an eyelet has been cut out.

17. A packed electric lamp as claimed in claim 1, characterized in that panels extend from the side walls to between the lamp and the back wall, which panels are connected to said side walls via folding lines and together substantially bridge the distance between the sleeves.

18. A packed electric lamp as claimed in claim 17, characterized in that the panels are coupled adjacent the lamp.

19. A packed electric lamp as claimed in claim 18, characterized in that the panels are coupled by means of matching shapes.

20. A packed electric lamp as claimed in claim 1, characterized in that a front panel is present at the first side wall, which front panel overlaps substantially only the first and the second front wall.

21. A packed electric lamp as claimed in claim 20, characterized in that the front panel comprises a side panel which overlaps the second side wall and is fastened thereto.

22. A packed electric lamp as claimed in claim 1, characterized in that the first front wall has a window through which the lamp cap can be viewed.

23. A packed electric lamp as claimed in claim 1, characterized in that a suspension tag with an eyelet has been cut from the top.

24. A packed electric lamp as claimed in claim 23, characterized in that the front panel has a top panel which overlaps the top and from which a suspension tag with an eyelet has been cut out.

* * * * *